US005901695A

United States Patent [19]

Deptolla

[11] Patent Number: 5,901,695

[45] Date of Patent: May 11, 1999

[54] GAS BURNER FOR COOKING PLACE

[75] Inventor: Uwe Deptolla, Menden, Germany

[73] Assignee: Cramer GmbH, Siegen, Germany

[21] Appl. No.: 08/790,118

[22] Filed: Jan. 29, 1997

[30] Foreign Application Priority Data

Feb. 7, 1996 [DE] Germany ..... 196 04 448

[51] Int. Cl.[6] ..... F24C 3/00

[52] U.S. Cl. ..... 126/39 R; 126/39 K; 431/354

[58] Field of Search ..... 126/39 R, 39 E, 126/39 K, 253, 248; 431/350, 351, 266, 353, 354, 265, 264; 239/461

[56] References Cited

U.S. PATENT DOCUMENTS

| | | | |
|---|---|---|---|
| 2,111,369 | 3/1938 | Marvin et al. | 126/214 D |
| 2,574,635 | 11/1951 | Franzheim . | |
| 3,406,002 | 10/1968 | Martin | 431/265 |
| 3,799,733 | 3/1974 | Tickell, Sr. | 431/183 |
| 4,788,962 | 12/1988 | Mashburn | 126/41 R |
| 5,149,262 | 9/1992 | Riehl | 126/39 K |
| 5,441,405 | 8/1995 | Bedford et al. | 431/354 |

FOREIGN PATENT DOCUMENTS

| | | | |
|---|---|---|---|
| 31185 | 10/1921 | Denmark | 126/39 K |
| 88484 | 9/1896 | Germany . | |
| 479592 | 6/1929 | Germany . | |
| 1118917 | 12/1961 | Germany . | |
| 1092622 | 7/1963 | Germany . | |
| 2839948 | 3/1980 | Germany | 431/354 |

*Primary Examiner*—James C. Yeung
*Attorney, Agent, or Firm*—Pearne, Gordon, McCoy & Granger LLP

[57] ABSTRACT

A gas burner for a cooking device. The gas burner includes a burner head connected to a mixing pipe. An impeller disk is disposed above the burner head and below a cover. The impeller disk is operable to swirl a gas stream and defines a generally circular inner opening. The impeller disk includes a body and a plurality of paddle-shaped flame guidance members formed by a plurality of evenly-spaced and radially-directed cuts in the body. The flame guidance members are bent such that edges of the flame guidance members form oblique angles with the body. The edges each have an end disposed above the body and another end disposed below the body.

20 Claims, 3 Drawing Sheets

GAS BURNER FOR COOKING PLACE

BACKGROUND OF THE INVENTION

The invention relates to a gas burner in general and, more particularly, to a gas burner having a mixing pipe and an impeller disk.

In known gas burners of this kind, a corrugated disk is provided having a central mounting opening and several passage openings located on an inner ring line for a gas mixture supplied from below. The corrugated disk also has an outer edge area showing waves or profilings for forming radially directed outlet openings for the gas. Under the corrugated disk, an apertured disk or a sieve is disposed for preventing the flame from going back into the mixing pipe, and above the corrugated disk, a cover disk is located which covers the upper edges of the waves or profilings for forming radial flow channels, as well as a cover whose rim is somewhat drawn to the inside downwardly and protrudes the corrugated disk. This arrangement consisting of several individual components is fixed to a burner head by means of a central disk. The corrugated disk therein creates flames directed radially to the outside and forming a radial flame circle depending on the burner size and the set gas pressure.

Such a burner has to meet various demands which partly are contradictory. The burner has to permit a so-called continuous ignition, i.e. during lighting one single flame coming out of the marginal opening must be capable of igniting the gas beam coming from the neighboring opening so that the burner is ignited all over the circle in short time and no un-used gas leaves. Continuous ignition, however, only is possible if the gas beam does not exit in too much of a focused manner and is somewhat swirled at the rim of the cover. This, however, once causes an undesired disturbance of the once ignited flame by the latter being diverted in direction of the cooking trough and said cooking trough being heated thereby.

The burner furthermore must be backfire-proof, ie. also even in case of low set flame the latter may not go back into the mixing pipe or continue burning in the burner head, since otherwise the burner might be destroyed after a short time. The already mentioned sieve or the punched disk, respectively, serves for safety against backfire.

For safety reasons it is necessary and prescribed in pertinent regulations that the created burning gases should be as free as possible of unburned gas and carbon monoxide. This primarily is done by adding an exactly dosed admixture of air into the mixing pipe in dependance on the governor position and by guiding the gas in the burner.

For reasons of easy handling a burner also should produce as little noise as possible. For this purpose an additional plate by which the noise is eliminated to a large degree is provided for positioning above the sieve plate.

Finally a gas burner should also have an efficiency as high as possible, this usually meaning the relation of the amount of energy supplied with the gas with respect to the amount of energy taken by the vessel to be heated. A given minimum efficiency is defined in the pertinent admission regulations. In the European standard EN 30 the minimum efficiency is 52 percent related to the heating power Ho.

SUMMARY OF THE INVENTION

The invention is based on the object of creating a gas burner which with a simple constructive design permits safe continuous ignition, prevents backfiring of the flame, burns with low noise and has an improved efficiency with improved hygienic behavior (CO content).

This object is solved by the features of claim 1. The impeller disk in advantageous manner is built as an annular disk having an inner circular opening. The inner and/or outer rim of the annular disk is provided with radially aligned cuts. The sections formed between said cuts are bent with their inner edges such that the edges form an acute angle with respect to the plane of the disk and one end of each edge can lie above and the other end below the plane of the disk.

The impeller disk of this design has the effect that the gas when leaving the gap between the burner head and the cover is swirled and is somewhat diverted in circumferential direction. Contrary to known gas burners which from a ring of strong flame beams directed radially to the outside a calm flame ring which has a tendency upwardly and inwardly over the rim of the cover is created in the burner in accordance with the present invention. In case of a vessel put thereon, the flame uniformly spreads almost over the entire bottom surface.

As there are no pronounced individual beams and the gas and/or the flame, respectively, flows somewhat to the inside over the cover, safe continuous ignition will take place when igniting, i.e. the flame immediately ignites over the entire circumference of the burner.

Furthermore, the impeller disk safely avoids backfire of the flame over the entire adjustment area of the burner. The burner works almost without noise and has a strongly improved efficiency as compared to other burners, this primarily being due to the fact that the heat transfer is effected over almost the entire bottom surface of the cooking vessel, whereas in the known gas burners mentioned in the beginning a comparatively large area in the center of the burner cover remains unheated and/or the flames go beyond the bottom of the cooking vessel.

The above elucidated advantages are achieved with a gas burner showing only two parts positioned on the burner head, namely the impeller disk and the cover. The cover can be of even shape at its rim, as its rim is not used for swirling the gas, rather the swirling is effected prior to exit of the gas mixture within the burner head. Known burners, however, require two additional parts, namely a sieve or an apertured disk for backfire safety and a cover disk for the impeller disk which als is used for avoiding noise.

The efficiency of the burner in accordance with the present invention could be increased to 59 and 68 percent, respectively, related to the heating power Hu, as has been shown by practical tests. Due to the improved burner gas exit ratio at the burner head and the better flame guidance, the heat dissipation of the burner to the cooking place and the components located therebelow is reduced so that smaller dimensions can be kept and separate isolation, respectively, can be omitted and other devices which might be located therebelow are less interfered with in their function.

The further claims deal with preferred embodiments.

Thus, the impeller disk may be loosely put onto the upper rim of the burner head and be held by a contraction. Alternatively, the impeller disk can also be fixed on the upper rim of the burner head by means of a locking connection. This kind of fixation is recommendable for gas burners of movable cooking devices or in camping vehicles in which a loosely placed impeller disk might be displaced by vibrations.

The cover is located directly on the upwardly projecting corners of the impeller disk and can if required be secured by a fixation.

If the cooking device accomodating the gas burner or burners has a cooking trough, the mixing pipe can be guided with a bent end section from bottom through the cooking trough of the cooking device and be supported with a flange under the cooking trough such that the cooking trough is caught between both parts. The mixing pipe therein somewhat protrudes in an upward direction with respect to the cooking trough, thereby preventing boilt-over liquids from reaching the mixing pipe. Furthermore, the clamping connection between the burner head, the cooking trough and the flange of the mixing pipe below the cooking trough is constructed such that a sealing connection is formed and no boiling-over liquid can reach the area below the cooking trough.

A special sealing of the cooking trough therefore is no longer required.

BRIEF DESCRIPTION OF THE DRAWINGS

Further features, advantages and particulars for the invention can be seen from the following description with reference to the drawings. In the drawings.

DETAILED DESCRIPTION OF THE PREFERRED EMBODIMENTS

The gas burner consists of a pot-shaped burner head 1 on whose upper rim an impeller disk 2 and a cover 3 are lying. Said burner head sits on the end bent upwardly, of a mixing pipe 4 coming from an injector (not shown).

Figure 3:
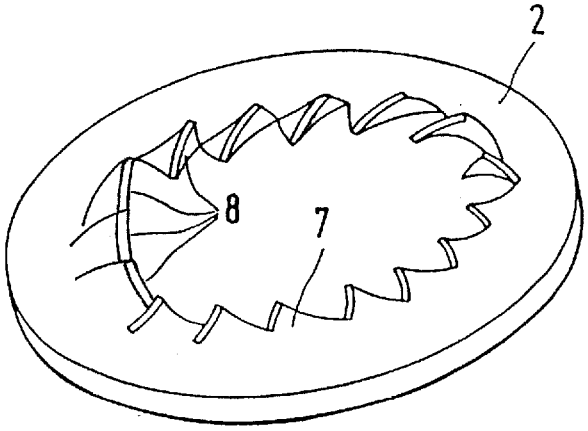
FIG. 3 is a perspective view of the impeller disk.
Figure 4:
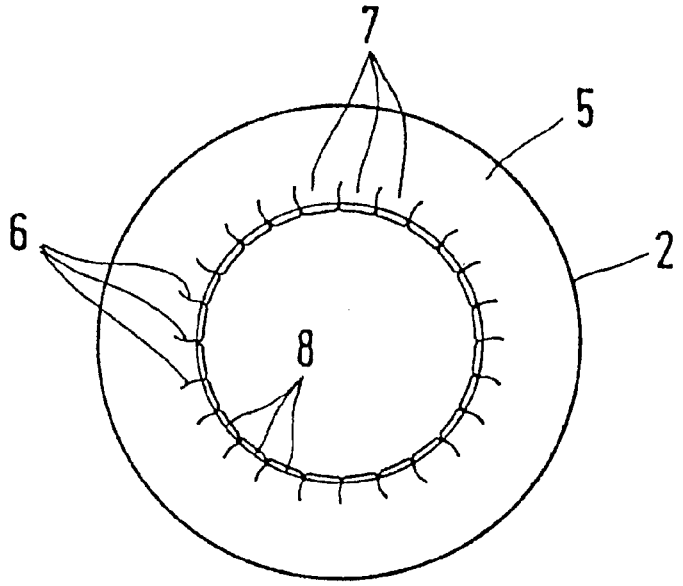
FIG. 4 is a top view onto the mixture passage of the impeller disk.
Figure 5:
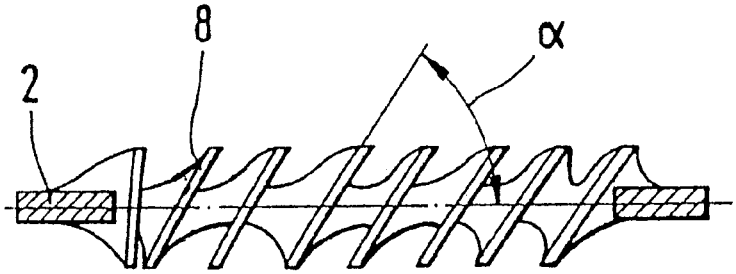
FIG. 5 is a section through the impeller disk.
Figure 6:
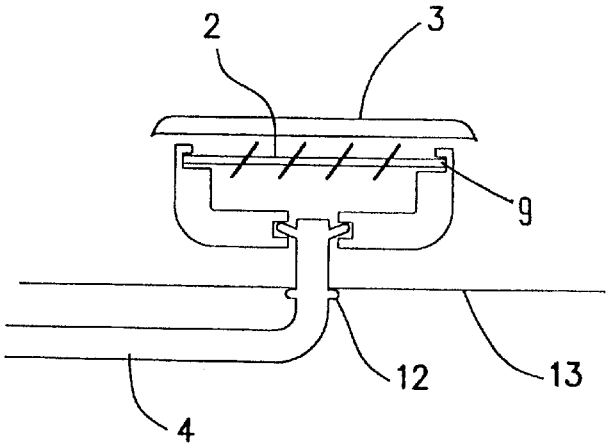
FIG. 6 shows a locking connection for securing the impeller disk to the burner head.
Figure 7:
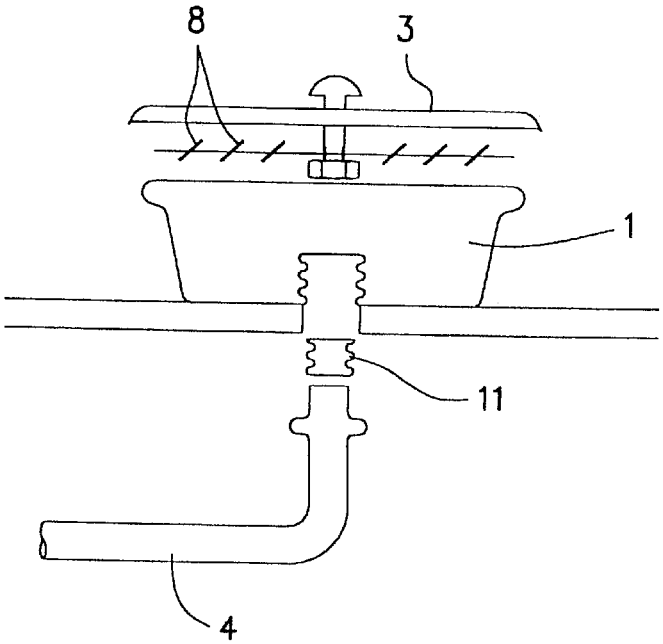
FIG. 7 shows a bolt for connecting the cover and the impeller disk.

The impeller disk 2 has the shape to be seen from FIGS. 3 to 5. The basic body is an annular disk having a diameter approximately corresponding to the diameter of the burner head 1. The outer marginal area 5 of the disk is plane. The inner marginal area comprises a plurality of radially extending cuts 6 extending over half of the ring width approximately. The cuts 6 forms sections 7 of about rectangular shape in section, whose inner edges 8 form the inner rim of the annular disk. Other sections can be arranged on the outer circumference of the impeller disk or in addition to, or in lieu of, the sections 7.

The inner edges 8 are bent with respect to the plane of the disk in a manner as can be seen in FIGS. 3 and 5, so that they form acute angles with said plane and protrude to both sides over the plane of the disk, like small paddles. All bent rims 8 therein are arranged in parallel with one another. The sections 7 thus form diverting surfaces swirling the passing gas and giving it a certain amount of angular momentum.

The cover 3 sits directly on the corners of the upwardly directed sections 8 so that the gas can only exit through the slots formed by the sections 7. On its outer rim the cover 3 has a contraction directed downwardly which somewhat protrudes over the rim of the burner head 1, thereby preventing liquid which might reach the cover 3 from entering the interior of the burner head.

Figure 1:
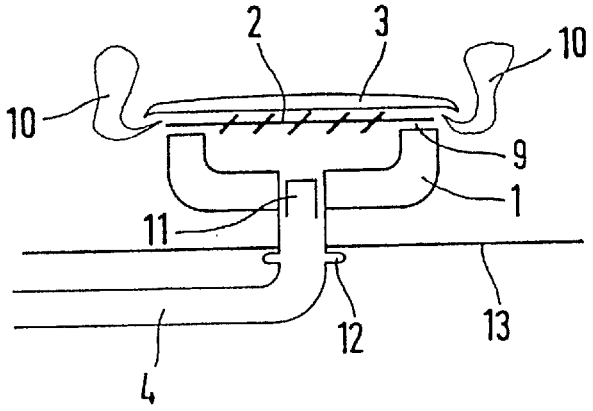
FIG. 1 shows a vertical section through a gas burner in accordance with the present invention.

According to FIG. 1 the impeller disk 2 is loosely put onto the upper rim of the burner head 1 which has a contraction 9 for centering the impeller disk. This construction mode is sufficient for cooking devices rigidly mounted and permits easy disassembly for cleaning and maintenance.

Figure 2:
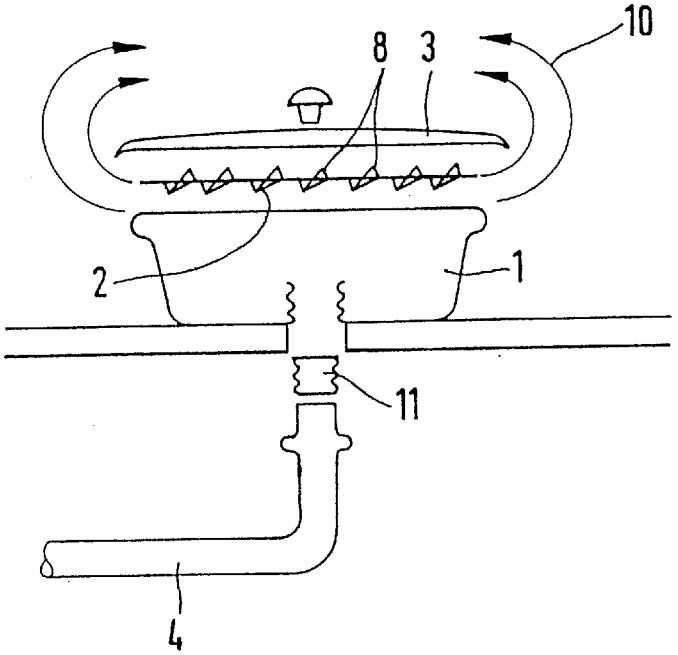
FIG. 2 shows an embodiment modified with respect to FIG. 1.

FIG. 2 shows an alternative arrangement in which the impeller disk 2 is fixed on the burner head by means of a locking connection. This kind of fixation is recommendable for portable cooking devices, like in camping vehicles, in which vibrations could cause a displacement of the impeller disk and maybe of the cover. Additionally, the cover 3 and the impeller disk 2 can be mutually connected by a centrally arranged fixation running in an axial direction, like a bolt, rivets and/or the like.

In FIG. 1 the spreading of the flame is indicated at 10. The flame is created on the exit slot of the gas between the rim of the burner head 1 and the cover 3 and spreads in annular manner around the cover 3. Above the cover it is drawn to the inside to some degree. During ignition the gas immediately ignites over the entire circumference of the burner.

The flame has no pronounced direction of beam and is smoothly burning without noise. It is uniformly spread over the bottom surface of a vessel put thereon and thus causes a heat transfer to almost the entire surface. This effect in particular is the basis for an improvement in efficiency from about 53 percent related to the burning power Hu in known gas burners to more than 56 percent or 68 percent, respectively, related to the burning power Hu in the present invention.

The waste gas is without objection with regard to the so-called burning hygienics, i.e. it does not contain toxical components and corresponds to the admission regulations valid for gas burners. Backfiring of the flame into the mixing pipe or internal burning in the burner head does not occur under any operating conditions.

The burner head 1 can be fixed on the mixing pipe 4 by means of a threaded sleeve 11. In the embodiment shown in FIG. 1 the mixing pipe 4 further includes a flange 12 contacting the bottom of the cooking trough 13 of the cooking device. In this way a sealing connection is created which prevents over-boiling liquid from reaching appliances located below the cooking trough. Thereby, an additional sealing can be omitted.

Figure 8:
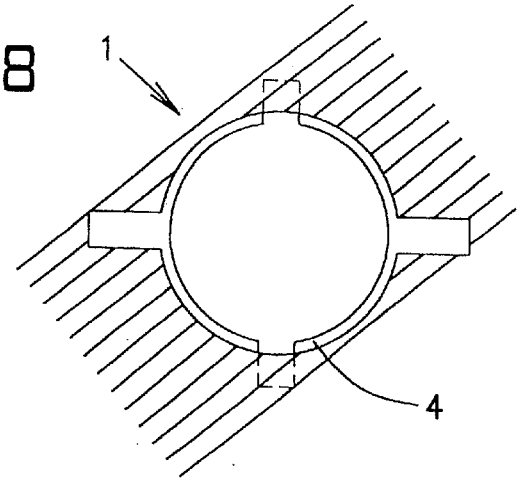
FIG. 8 illustrates a bayonet connection between the burner head and mixing pipe.

In another embodiment (FIG. 8), the burner head 1 can also be fixed by means of an easily detachable connection, e.g. a bayonette closure, on the mixing pipe.

In the embodiment of FIG. 2 the end of the mixing pipe 4 somewhat protrudes over the cooking trough 13 with an overhang so that the entry of cooking items into the mixing pipe 4 is avoided and an additional sealing can be avoided.

What is claimed:

1. A gas burner in combination with a cooking device, said gas burner comprising:

a mixing pipe;

a burner head connected to the mixing pipe and operable to discharge a stream of gas;

a cover spaced above the burner head;

a profiled impeller disk disposed between the cover and the burner head, said disk receiving said gas stream and producing a swirling gas stream between said disk and said cover, said impeller disk defining a generally circular inner opening and including a body and a plurality of paddle-shaped flame guidance members extending away from the body; and means for interconnecting the burner head, the cover, and the impeller disk.

2. The gas burner in combination with the cooking device of claim 1, wherein the flame guidance members are comprised of sections formed in the body by a plurality of radially-directed cuts, said sections being bent such that edges of the sections form acute angles with the body.

3. The gas burner in combination with the cooking device of claim 2, wherein one end of the edge of each section is disposed above the body and another end of the edge of each section is disposed below the body.

4. The gas burner in combination with the cooking device of claim 1, wherein the flame guidance members are disposed around the inner opening.

5. The gas burner in combination with the cooking device of claim 1 wherein the burner head has an upper rim with a contraction within which the impeller disk is disposed.

6. The gas burner in combination with the cooking device of claim 1 wherein the burner head has an upper rim, and further comprising a locking connection that secures the impeller disk to the upper rim of the burner head.

7. The gas burner in combination with the cooking device of claim 1 wherein the interconnecting means comprises a bolt extending axially through center portions of the cover and the impeller disk.

8. The gas burner in combination with the cooking device of claim 1 further comprising a threaded sleeve that secures the burner head to the mixing pipe.

9. The gas burner in combination with the cooking device of claim 1 further comprising a bayonet closure that connects the burner head to the mixing pipe.

10. The gas burner in combination with the cooking device of claim 1 wherein the cooking device comprises a cooking trough defining a bottom opening, and wherein said mixing pipe has a bend formed therein and extends through the bottom opening and is supported on the cooking trough.

11. A gas burner in combination with a cooking device, said cooking device comprising a cooking trough defining a bottom opening, said gas burner comprising:

a mixing pipe, said mixing pipe having a bend formed therein and extending through the bottom opening and being supported on the cooking trough;

a flange that supports the mixing pipe on the cooking trough, said flange being disposed below the cooking trough so as to trap the cooking trough in a sealing manner between the burner head and the flange;

a burner head connected to the mixing pipe;

a cover spaced above the burner head;

a profiled impeller disk disposed below the cover and operable to swirl a gas stream, said impeller disk defining a generally circular inner opening and including a body and a plurality of paddle-shaped flame guidance members extending away from the body; and means for interconnecting the burner head, the cover, and the impeller disk.

12. The gas burner in combination with the cooking device of claim 11 wherein the mixing pipe has an end disposed above the cooking trough.

13. The gas burner in combination with the cooking device of claim 11, wherein the flame guidance members are comprised of sections formed in the body by a plurality of radially-directed cuts, said sections being bent such that edges of the sections form acute angles with the body.

14. The gas burner in combination with the cooking device of claim 13, wherein one end of the edge of each section is disposed above the body and another end of the edge of each section is disposed below the body.

15. The gas burner in combination with the cooking device of claim 11, wherein the flame guidance members are disposed around the inner opening.

16. The gas burner in combination with the cooking device of claim 11 wherein the burner head has an upper rim with a contraction within which the impeller disk is disposed.

17. The gas burner in combination with the cooking device of claim 11 wherein the burner head has an upper rim, and further comprising a locking connection that secures the impeller disk to the upper rim of the burner head.

18. The gas burner in combination with the cooking device of claim 11 wherein the interconnecting means comprises a bolt extending axially through center portions of the cover and the impeller disk.

19. The gas burner in combination with the cooking device of claim 11 further comprising a threaded sleave that secures the burner head to the mixing pipe.

20. The gas burner in combination with the cooking device of claim 11 further comprising a bayonet closure that connects the burner head to the mixing pipe.

* * * * *